US009728159B2

(12) United States Patent
Daly et al.

(10) Patent No.: US 9,728,159 B2
(45) Date of Patent: Aug. 8, 2017

(54) SYSTEMS AND METHODS FOR ISO-PERCEPTIBLE POWER REDUCTION FOR DISPLAYS

(71) Applicant: Dolby Laboratories Licensing Corporation, San Francisco, CA (US)

(72) Inventors: Scott Daly, Kalama, WA (US); Hadi Hadizadeh, Burnaby (CA); Ivan V. Bajic, Vancouver (CA); Parvaneh Saeedi, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 249 days.

(21) Appl. No.: 14/386,332

(22) PCT Filed: Mar. 6, 2013

(86) PCT No.: PCT/US2013/029404

§ 371 (c)(1),
(2) Date: Sep. 18, 2014

(87) PCT Pub. No.: WO2013/142067

PCT Pub. Date: Sep. 26, 2013

(65) Prior Publication Data

US 2015/0029210 A1 Jan. 29, 2015

Related U.S. Application Data

(60) Provisional application No. 61/613,879, filed on Mar. 21, 2012.

(51) Int. Cl.
*G09G 5/02* (2006.01)

(52) U.S. Cl.
CPC ..... *G09G 5/02* (2013.01); *G09G 2320/0666* (2013.01); *G09G 2330/021* (2013.01); *G09G 2340/0428* (2013.01); *G09G 2340/06* (2013.01)

(58) Field of Classification Search
None
See application file for complete search history.

(56) References Cited

U.S. PATENT DOCUMENTS 5,463,702 A 10/1995 Trueblood
5,638,190 A 6/1997 Geist
(Continued)

FOREIGN PATENT DOCUMENTS

KR 2003-0085336 11/2003

OTHER PUBLICATIONS

Keita Hirai, Jambal Tumurtogoo, Ayano Kikuchi, Norimichi Tsumura, Toshiya Nakaguchi, and Yoichi Miyake, "Video Quality Assessment using Spatio-Velocity Contrast Sensitivity Function", 2009, IEICE.*

(Continued)

*Primary Examiner* — Mark Zimmerman
*Assistant Examiner* — Yu-Jang Tswei

(57) ABSTRACT

Several embodiments of systems and methods are disclosed that create iso-perceptible image data from input image data. Such iso-perceptible image data may be created from Just-Noticeable-Difference (JND) modeling that leverages models from the Human Visual System (HVS). From a set of iso-perceptible image data set, an output image data may be selected, such that the chosen output image data has a less power and/or energy requirement to render than the input image data. Further, the output image data may have a substantially lower power and/or energy requirement than the set of iso-perceptible image data.

4 Claims, 2 Drawing Sheets

(56) References Cited

U.S. PATENT DOCUMENTS

| | | | | |
|---|---|---|---|---|
| 5,933,194 | A * | 8/1999 | Kim | H04N 19/176 348/403.1 |
| 6,243,497 | B1 | 6/2001 | Chiang | |
| 7,536,059 | B2 | 5/2009 | Xu | |
| 8,035,604 | B2 | 10/2011 | Seetzen | |
| 8,189,858 | B2 | 5/2012 | Lubin | |
| 8,594,178 | B2 | 11/2013 | Li | |
| 8,654,835 | B2 | 2/2014 | Li | |
| 8,681,189 | B2 | 3/2014 | Wallener | |
| 2006/0033844 | A1 | 2/2006 | Park | |
| 2006/0215893 | A1 | 9/2006 | Johnson | |
| 2008/0131014 | A1* | 6/2008 | Lee | H04N 19/154 382/251 |
| 2008/0144946 | A1 | 6/2008 | Naccari | |
| 2009/0040564 | A1 | 2/2009 | Granger | |
| 2009/0322800 | A1 | 12/2009 | Atkins | |
| 2010/0303150 | A1* | 12/2010 | Hsiung | H04N 19/12 375/240.08 |
| 2011/0069082 | A1 | 3/2011 | Ishidera | |
| 2011/0134125 | A1 | 6/2011 | Chen | |
| 2011/0175552 | A1 | 7/2011 | Kwon | |
| 2011/0194618 | A1 | 8/2011 | Gish | |
| 2011/0279749 | A1 | 11/2011 | Erinjippurath | |
| 2011/0316973 | A1 | 12/2011 | Miller | |

OTHER PUBLICATIONS

Chuang, J. et al "Energy Aware Color Sets" Computer Graphics Forum (Proc. Eurographics 2009), vol. 28, No. 2, pp. 203-211, Apr. 2009.

Sharma, G. "Digital Color Imaging Handbook" Electrical Engineering & Applied Signal Processing Series, Dec. 23, 2002 by CRC Press.

Chou, C.H. et al "A Perceptually Tuned Subband Image Coder Based on the Measure of Just-Noticeable Distortion Profile" IEEE Trans. Image Processing, vol. 5, No. 6, pp. 467-476, Dec. 1995.

Kerofsky, L. et al "Brightness Preservation for LCD Backlight Reduction" SID Ann. Tech. Digest, 2006.

Yang, X. et al "Motion-Compensated Residue Preprocessing in Video Coding Based on Just-Noticeable Distortion Profile", IEEE Trans. Circuits Syst. Video Technology, vol. 15, No. 6, pp. 745-752, Jun. 2005.

Mantiuk, R. et al "Predicting Visible Differences in High Dynamic Range Images—Model and its Calibration", Proc. SPIE, vol. 5666, pp. 204-214, Mar. 18, 2005.

Wu, Xiaolin "Efficient Statistical Computations for Optimal Color Quantization" Graphics Gems II, pp. 126-133, 1991.

Nelder, J.A., et al "A Simplex Method for Function Minimization" The Computer Journal, vol. 7, No. 4, pp. 308-313, 1965.

"Kodak Lossless True Color Image Database" available online: http://www.r0k.us/graphics/kodak/.

Wu, X. et al "Linear Programming Approach for Optimal Contrast-Tone Mapping", IEEE Trans. Image Processing, vol. 20, Issue 5, Nov. 15, 2010.

Hadizadeh, H. et al "Good-Looking Green Images" Proc. IEEE ICIP, pp. 3238-3241, Brussels, Belgium, Sep. 2011.

Liu, K.C. et al "Locally Adaptive Perceptual Compression for Color Images" IEICE Transactions on Fundamentals of Electronics, Communications and Computer Sciences, vol. E91-A, No. 8, pp. 2213-2222, Aug. 2008.

Poncino, M. et al "Low-Energy RGB Color Approximation for Digital LCD Interlaces" IEEE Transactions on Consumer Electronics, vol. 52, No. 3, pp. 1004-1012, published in Aug. 2006.

Nurrachmat, A. et al "Low-Energy Pixel Approximation for DVI-Based LCD Interfaces" IEEE International Symposium on Circuits and Systems, May 21-24, 2006.

Chou, Chun-Hsien, et al "A Visual Model for Estimating Perceptual Redundancy Inherent in Color Image" Advances in Multimedia Information Processing, Third IEEE Pacific Rim Conference on Multimedia Proceedings, pp. 353-360, Dec. 16-18, 2002.

Sreelekha, G. et al "An HVS based Adaptive Quantization Scheme for the Compression of Color Images" Digital Signal Processing, vol. 20, No. 4, pp. 1129-1149, Jul. 2010.

Kim, Keyong Man, et al "Color Image Quantization Using Weighted Distortion Measure of HVS Color Activity" IEEE, International Conference on Image Processing, pp. 1035-1039, vol. 3, Sep. 16-19, 1996.

Le Callet, P. et al "Psychovisual Quantization of Color Images" First European Conference on Colour in Graphics, Imaging and Vision, published in Dec. 2002.

Yoon, Kuk-Jin, et al "Human Perception Based Color Image Quantization" Proc. of the 17th International Conference on Pattern Recognition, vol. 1, pp. 664-667, Aug. 23-26, 2004.

Chang, Yu-Chou, et al "Color Image Quantization Using Color Variation Measure" First IEEE Symposium on Computational Intelligence in Image and Signal Processing, Apr. 1-5, 2007.

Chou, Chun-Hsien, et al "Perceptually Optimized JPEG2000 Coder Based on CIEDE2000 Color Difference Equation" IEEE International Conference on Image Processing, vol. 3, pp. 1184-1187, Sep. 11-14, 2005.

Hirai, K. et al "Video Quality Assessment Using Spatio-Velocity Contrast Sensitivity Function" IEICE Transactions on Information and Systems, May 1, 2010, Image Processing and Video Processing.

Laird, J. et al "Spatio-Velocity CSF as a Function of Retinal Velocity Using Unstabilized Stimuli" Proc. of SPIE-IS&T Electronic Imaging, SPIE, vol. 6057, 2006.

Daly, Scott, "Engineering Observations from SpatioVelocity and Spatiotemporal Visual Models" Chapter 9 in Vision Models and Applications to Image and Video Processing, 2001, Kluwer Academic Publishers, pp. 179-200.

Hirai, K. et al "SV-CIELAB: Video Quality Assessment Using Spatio-Velocity Contrast Sensitivity Function" 17th Color Imaging Conference Final Program and Proceedings, 2009 Society for Imaging Science and Technology, pp. 35-41.

* cited by examiner

SYSTEMS AND METHODS FOR ISO-PERCEPTIBLE POWER REDUCTION FOR DISPLAYS

CROSS-REFERENCE TO RELATED APPLICATIONS

This application claims the benefit of priority to U.S. Provisional Patent Application Ser. No. 61/613,879 filed on 21 Mar. 2012, hereby incorporated by reference in its entirety.

TECHNICAL FIELD OF THE INVENTION

The present invention relates to displays systems and, more particularly, to novel display systems exhibiting energy efficiency by leveraging aspects of the Human Visual System (HVS).

BACKGROUND OF THE INVENTION

In the field of image and/or video processing, it is known that display systems may use certain aspects of the HVS to achieve certain efficiencies in processing or image quality. For example, the following, co-owned, patent applications disclose similar subject matter: (1) United States Patent Publication Number 20110194618, published Aug. 11, 2011; (2) United States Patent Publication Number 20110170591, published Jul. 14, 2011; (3) United States Patent Publication Number 20110169881, published Jul. 14, 2011; (4) United States Patent Publication Number 20110103473, published May 5, 2011 and; (5) U.S. Pat. No. 8,189,858, issued 29 May 2012—all of which are incorporated by reference in their entirety.

SUMMARY OF THE INVENTION

Several embodiments of display systems and methods of their manufacture and use are herein disclosed.

Several embodiments of systems and methods are disclosed that create iso-perceptible image data from input image data. Such iso-perceptible image data may be created from Just-Noticeable-Difference (JND) modeling that leverages models of the Human Visual System (HVS). From a set of iso-perceptible image data set, an output image data may be selected, such that the chosen output image data has a lower power and/or energy requirement to render than the input image data. Further, the output image data may have substantially lower power and/or energy requirement than the set of iso-perceptible image data.

In one embodiment, a system is disclosed that comprises: a color quantizer module for color quantizing input image data; a just-noticeable-difference (JND) module that creates an intermediate set of image data that is substantially iso-perceptible from the color quantized input image data; and a power reducing module that selects an output image data from the intermediate set of image data, such that said output image data comprises a lower power requirement for rendering said output image data as compared with said input image data.

In another embodiment, a method for image processing is disclosed that comprises the steps of: color quantizing input image data; creating a just-noticeable-difference (JND) set of image data which is substantially iso-perceptible to the input image data; and selecting an output image data where the output image data is chosen among said JND set of image data and the output image data comprises a lower power requirement for rendering than the input image data.

Other features and advantages of the present system are presented below in the Detailed Description when read in connection with the drawings presented within this application.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Figure 1:
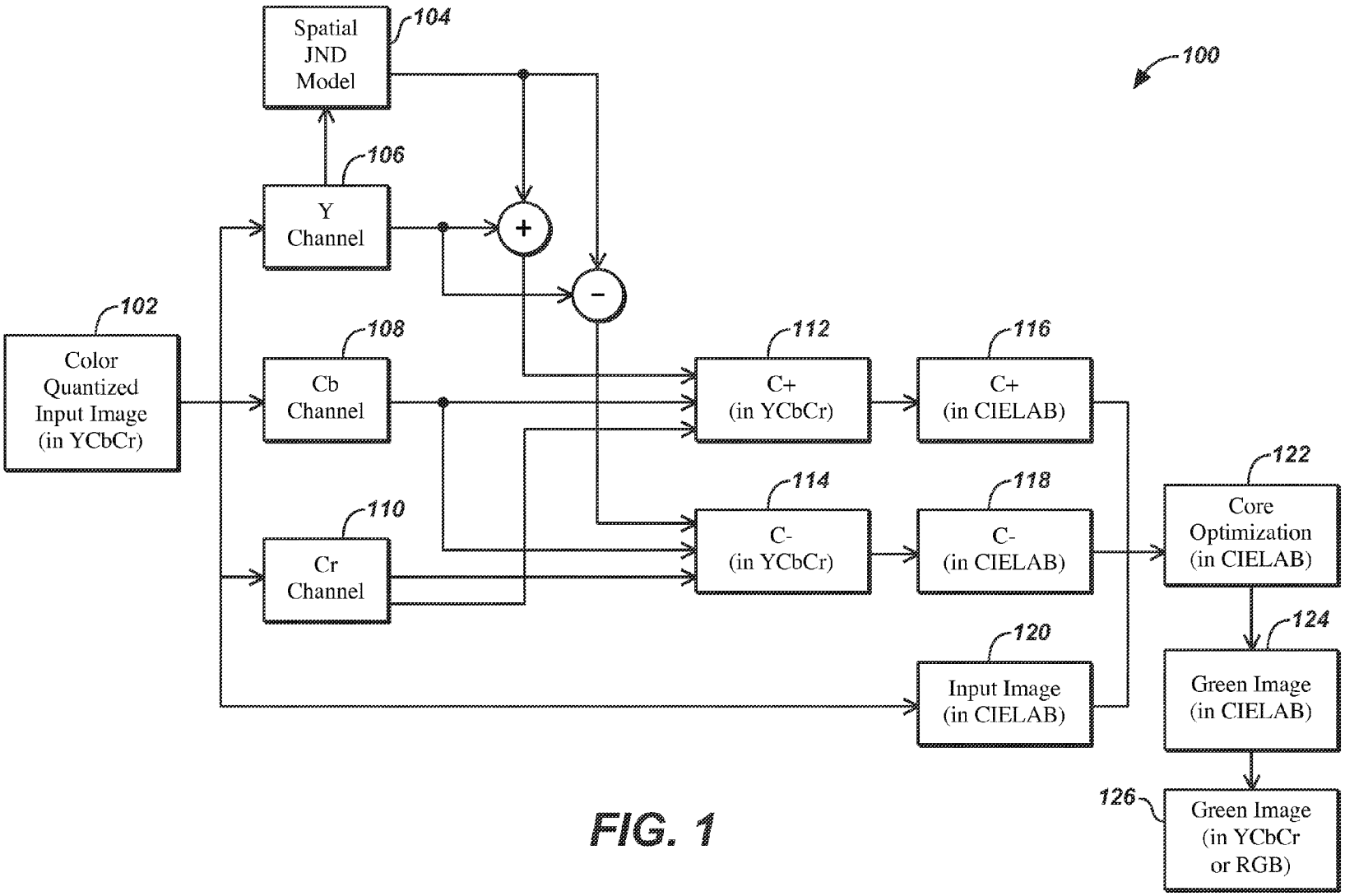
FIG. 1 shows an embodiment of an iso-perceptible, power reducing processor block made in accordance with the principles of the present application.

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Introduction

In several embodiments disclosed herein, systems and methods are presented, employing perceptually-based algorithms to generate images that consume less energy than conventionally color-quantized (CQ) images when displayed on an energy-adaptive display. In addition, these systems and embodiments may have the same or better perceptual quality as conventional displays not employing such algorithms.

Energy-adaptive displays describe those whose power depends on the combination of power consumed by each pixel, and in particular, the brightness of the pixel. The term CQ may include an approach where an image is rendered with an image-dependent color map with a reduced number of bits. But it can also refer to the common uniform quantization across color layers, such as 8 bit/color/pixel for each R, G, and B channels (e.g., 24 bits color). Also, higher levels of quality than 24 bits are included, such as 10 bits/pixel (30 bits color), 12 bits/pixel (36 bits color), etc.

Starting with a CQ image, colors may be first converted to a color space where all colors within a sphere of a suitably chosen radius may be considered as perceptually indistinguishable—e.g. CIELAB. A Just-Noticeable-Difference (JND) model may be employed to find the radii of such spheres, which may then be subject to search for an alternative color that consumes less energy, and is, at the same time, mostly or substantially perceptually indistinguishable (i.e., iso-perceptible) from the original color. This process may be repeated for all pixels to obtain the reduced energy or "green" version of the input CQ image. To evaluate the performance of the proposed algorithm, we performed a subjective experiment on a standard Kodak color image database. Some experimental results indicate that such "green" images look the same or often have better contrast and better subjective quality than the original CQ images.

In many embodiments, JND models may be incorporated comprising luminance and texture masking effects in order to preserve (or improve) the perceptual quality of the produced images, as well as extensive subjective evaluation of the resulting images.

Display Energy Consumption

Displays are known as the main consumers of electrical energy in computers and mobile devices, using up to 38 percent of the total power in desktop computers and up to 50 percent of the total power in mobile devices. Conventional thin film transistor liquid crystal displays (TFT LCDs) use a single uniform backlight system, which consumes a large amount of energy, much of which is wasted due to LCD modulation and low transmissivity. Unlike TFT LCDs, the emerging display technologies such as direct-view LED tile arrays, organic light-emitting diode (OLED) displays, as well as modern dual-layer high dynamic range (HDR) displays (e.g. with backlight modulation) consume energy in a more controllable and efficient manner. Such displays are further disclosed in co-owned applications: (1) U.S. Pat. No. 8,035,604, issued on 11 Oct. 2011; (2) United States Patent Publication Number 20090322800, published on Dec. 31, 2009; (3) United States Patent Publication Number 20110279749, published on Nov. 17, 2011—which are hereby incorporated by reference in their entirety. In such displays, the conventional backlight may be replaced by an array of individually controllable LEDs which can be left in a low or off state when they are illuminating dark regions of the image.

In many embodiments, the consumed energy in energy-adaptive displays may be proportional to the number of 'ON' pixels, and the brightness of their R, G, and B components, summed over the pixel positions. Different colors and different patterns may use different amounts of energy. In one embodiment, the sum of linear luminance (e.g., non-gamma-corrected) RGB components may be used as a simple measure of the energy consumption of a pixel in an OLED display. This measure may become truer as the display gets larger and the power due to the emissive components dominates over the video signal driving or other supportive circuitry. Hence, if C=(R,G,B) is the color of a particular pixel, one possible corresponding display energy might be given by:

$$E(C)=R+G+B \tag{1}$$

It will be appreciated that other possible energy measures may be possible. For example, it is possible to place weights on R, G and B values to reflect their differing efficiencies, e.g., due to their power to luminance efficiencies, as well as due to the HVS V-lambda weighting. It should also be noted that various hardware techniques, such as ambient-based backlight modulation combined with histogram analysis, and LCD compensation with backlight reduction, may also be used to achieve energy savings. In one embodiment, the system may be concerned with pixel-level energy consumption. It should be appreciated that many embodiments herein may be used in conjunction with many hardware techniques in order to increase the amount of energy saving even more.

Color and Human Visual Perception

The Human Visual System (HVS) may not sense changes below the just-noticeable-difference (JND) threshold. It is known in the art to estimate spatial and temporal JND thresholds. For purposes of the present application, it is possible to employ a spatial luminance JND estimator in the pixel domain for the YCbCr color space. In many embodiments, it is possible to employ two dominant masking effects—(1) background luminance masking (also referred to as light response compression) and (2) texture masking—as follows:

$$\mathrm{JND}_Y(x,y)=T_l(x,y)+T_{t,Y}(x,y)-C_{l,t}\min\{T_l(x,y)+T_{t,Y}(x,y)\} \tag{2}$$

where $\mathrm{JND}_Y(x,y)$ is the spatial luminance JND value of pixel at location (x,y), $T_l(x,y)$ and $T_{t,Y}(x,y)$ are the visibility thresholds for the background luminance masking and texture masking, respectively, and $C_{l,t}=0.34$ is a weighting factor that controls the overlapping effect in masking, since the two aforementioned masking factors may coexist in some images. It should be noted that due to $T_l(x,y)$, the JND threshold in dark regions of the image may be larger, which means that in some embodiments, more visual distortion may be hidden in darker regions. Such hiding may be dependent on a number of factors—e.g.: (1) display reflectivity, (2) ambient light levels, (3) number and size of bright regions and (4) display format (such as gamma-corrected, density domain). Also, due to $T_{t,Y}(x,y)$, the JND threshold in more textured regions may be larger, which means that in some embodiments, more textured regions may hide more visual distortions. Therefore, the abovementioned JND model may predict a JND threshold for each pixel within the image based on the local context around the pixel.

To display an image on a quantized display, it may be desirable to make a measure of the difference between colors. Thus, in some embodiments, it is possible to employ the CIELAB color space (or other suitable color space). In one embodiment, it is possible to compute the difference between two colors in CIELAB using the CIEDE2000 color distance, which is labeled $D_{00}$. This distance may possess perceptual uniformity properties, e.g. such that the distance between two colors approximately tends to correspond to their perceptual difference. For large uniform color patches, $D_{00}=2.3$ may be considered as color JND for consumer viewing. For professional applications, a JND of 0.5 may be closer to threshold. However, JND in natural images may be affected by visual masking and may not be the same for all pixels. In some embodiments, the interplay between the JND threshold which incorporates masking effects, and $D_{00}$ in CIELAB, may be employed to desirable effect.

One Embodiment

Now it will be described an embodiment comprising some of the techniques as disclosed herein. For merely expository purposes, some terminology will be discussed; however, the scope of the present application should not necessarily be limited to the terminology and examples are given herein.

In one embodiment, a system for processing input image and/or video data may comprises a module to color quantize input image and/or video data, a module to create a set of intermediate image data which may be substantially iso-perceptible to the input image data and a module to examine such an intermediate set of substantially iso-perceptible image data and selects one output image data that represents substantially the least power needed to render the image. In many embodiments, it may be desired to select a minimum energy and/or power output image data; however, if it may reduce the computational complexity, it may be possible to select an output value that—while not absolutely minimum power requirement—is less than power required for the input image data and/or a subset of the intermediate set as mentioned.

Consider a color image I of size W×H pixels. Let r=(x,y) denote the pixel location within I, and C(r) be the color of the pixel at location r. The image may first be color quantized (CQ), as is known in the art. Let $\tilde{I}$ be the CQ version of I, $\{C_1, C_2, \ldots, C_N\}$ be the set of N distinct colors in $\tilde{I}$, and $P_i=\{r\epsilon\tilde{I}:C(r)=C_i\}$ be the set of all pixels in $\tilde{I}$ with color $C_i$, i=1, 2, . . . , N. In this embodiment, it may be desired to replace each color $C_i$ with another color, such that the total energy consumption of the image is reduced, while the perceptual quality of the new image approximately equivalent compared to the original CQ image. In this embodiment, this may be affected by first casting this problem as an optimization problem, and then solve it via an optimization method.

Let C=(Y,Cb,Cr) be the YCbCr color of a given pixel in $\tilde{I}$. Let $JND_Y$ be the spatial luminance JND of this pixel, as may be computed as in (2) from the luminance (Y) component of $\tilde{I}$.

Given $JND_Y$, two new colors C+ and C− may be generated from C by adding and subtracting $JND_Y$ to or from the luminance component of C as follows $$C+=(Y+JND_Y,Cb,Cr),$$

$$C-=(Y-JND_Y,Cb,Cr) \quad (3)$$

These two new colors may be considered perceptually indistinguishable from C, since their chroma components are the same as those of C, and the difference between their luminance components and the luminance component of C does not exceed the JND threshold. The three colors (C, C+, C−) may then be transformed to CIELAB, and the CIEDE2000 distances between them may be calculated:

$$R+=D_{00}(C,C+),$$

$$R-=D_{00}(C,C-) \quad (4)$$

It should be noted that, due to the nonlinear transformation from YCbCr to CIELAB, R+ may be different from R−. It is possible to set R=min{R+,R−}. Now, all colors in CIELAB whose distance $D_{00}$ from C does not exceed R should be perceptually indistinguishable from C. These colors tend to form a sphere (with respect to $D_{00}$) in the CIELAB space. One possible new color might thus be a color within the sphere whose energy E is minimal.

In this embodiment, the above process may be repeated for each pixel $r\in\tilde{I}$. With $C(r)=C_i$ denoting the original CQ color of the pixel r, and R (r) denoting the corresponding color distance above, it is possible to search for a new color $C_{new}$ so as to $$\text{minimize } E(C_{new}),$$

$$\text{subject to } D_{00}(C_i,C_{new})\leq R_i \quad (5)$$

where $$R_i = \frac{1}{M}\left(\sum R(r)\right),$$

M is the cardinality of $P_i$, and the summation is taken over $r\in P_i$. To solve this optimization problem, it is possible to use a downhill simplex method with—e.g., 100 iterations. The solution $C_{new}$ may then replace $C_i$ in the new "green" image. Hence, the new image will tend to have the same number of colors (or possibly less due to probabilistic binning) as the original CQ image, but its display energy may be reduced.

For many viewing conditions, such as bright ambient and high reflectivity panel glass, one such embodiment may result in dark pixels contributing more towards energy minimization than bright pixels, due to the background luminance masking term in (2). The JND visibility threshold of dark pixels is usually higher than that of bright pixels. Due to ambient light levels being bright, relatively high reflectivity, and bright image regions causing flare in the human eye, the contrast reaching the retina may be more reduced in the dark regions, thus allowing more errors there. So the larger the JND threshold, the larger the term $R_i$ will tend to be in (5)—which in turn means that the energy (and also the luminance) of dark pixels may be reduced more than that of bright pixels. In other conditions, such as dark ambient (e.g., home or movie theater), more reduction may be possible for brighter regions. In one possible embodiment—i.e., comprising uncalibrated parameters of display and bright viewing; and lack of spatial frequency considerations—a side effect may occur. To wit, the contrast of the new image may be increased compared to the original CQ image. Due to hardware limitations, such an approach may be desired for certain applications.

FIG. 1 depicts a block diagram 100 of one embodiment of the present application. Color quantizer 102 quantizes the input image in, say YCbCr space. As may be seen, spatial JND model block 104 provides an appropriate value—to be combined with values from Y, Cb, Cr channels (106, 108 and 110 respectively) as noted herein. The resulting C+ and C− blocks 112 and 114 may be computed in, e.g., YCbCr and converted to CIELAB values in 116 and 118 respectively. Thereafter, C+, C− together with input image values in CIELAB as given from 120 may then be used to produce the optimization as described herein at 122 in, say CIELAB. A green image may then be produced in 124 and converted in an appropriate space for the application (e.g., YCbCr, RGB or the like).

It will be appreciated that the embodiment of FIG. 1 may be a part of any number of image processing pipelines that might be found in a display, a codec or at any number of suitable points in an image pipeline. It should also be appreciated that—while the embodiment of FIG. 1 may be scaled down to operate on an individual pixel—this architecture may also be scaled up appropriately to process an entire image.

A Second Embodiment

While FIG. 1 is sufficient to affect the production of green output from input images and/or video, there are other embodiments that may also have good application to video input.

In such other embodiments, it is possible to take input image data and produces CQ image values. These CQ image values may then be transformed into some suitable opponent color space—e.g., L*a*b*. From here, several embodiments may be possible. For example, it is possible to replace the optimization search with a sorting of various L*, a*, and b* combinations. It may also be possible to perturb the L* component and/or channel—as well as perturb the a* and b* components and/or channels—by their respective JND limits. It is also possible to add a spatiovelocity CSF (SV-CSF) model (e.g. implemented as a filter). In addition, it may be possible to include actual display primary luminous efficiencies in the rendering selection process.

Figure 2:
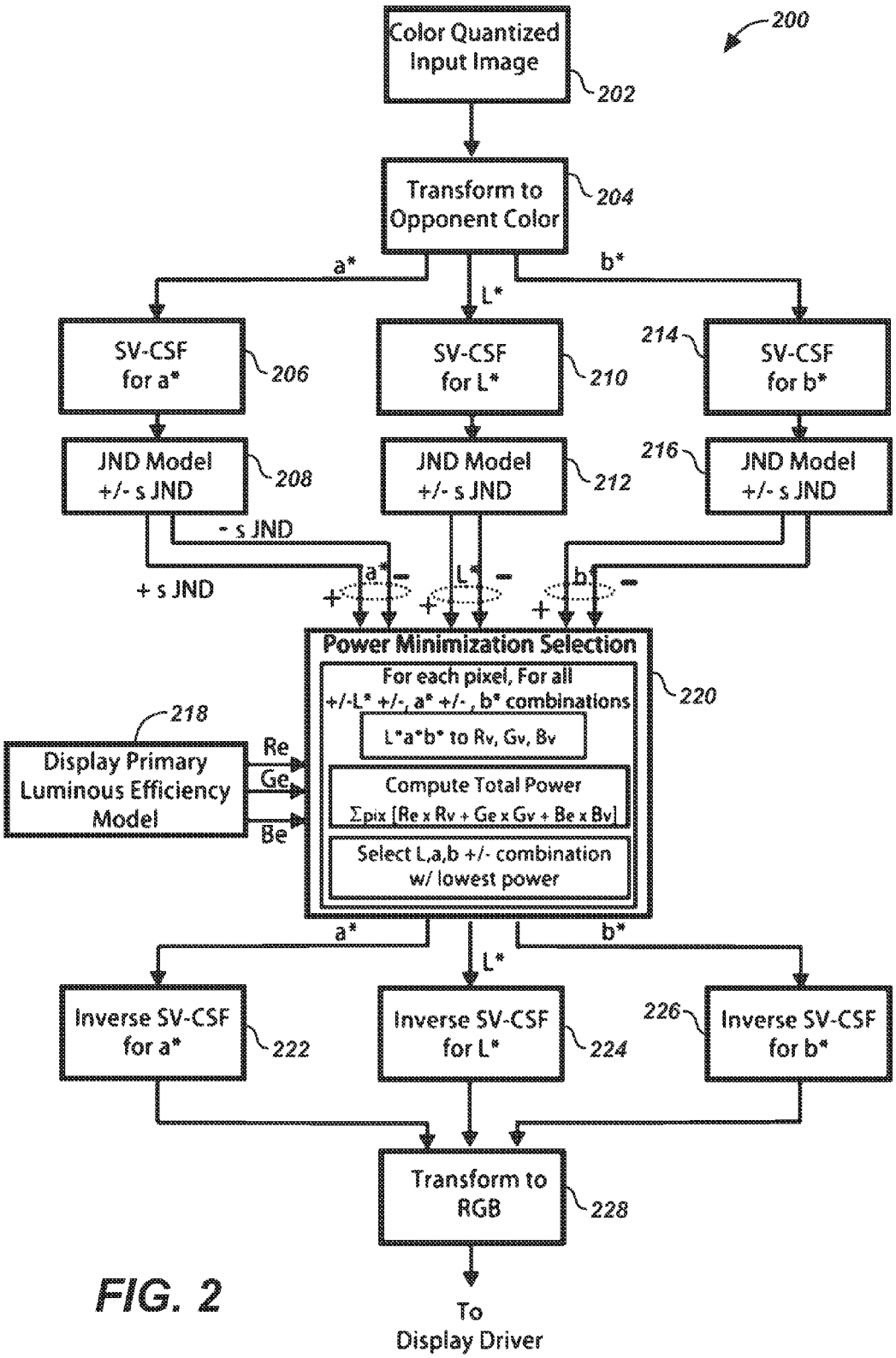
FIG. 2 shows another embodiment of an iso-perceptible, power reducing processor block made in accordance with the principles of the present application.

FIG. 2 is one such embodiment as presently discussed. Image input may be color quantized in block 202. The input image may be in any trichromatic format, such as RGB, XYZ, ACES, OCES, etc. that is subject to CQ. These CQ values may be converted to a suitable opponent color space in block 204. Examples of such opponent color spaces might include the video Y, Cr, Cb, or the CIE L*a*b*, or a physiological L+M, L−M, L+M−S representation. In some cases, the input image frame may already be in such a space, in which case this transform block and/or step may be omitted. In such cases, it may be possible to affect YCrCb to CIELAB conversion for better performance, but this is not necessary.

Once in the opponent color space, it is possible to filter the images by a spatiovelocity CSF (e.g. blocks 206, 210, and 214 respectively for the three channels depicted). This SV-CSF filtering may be a lowpass filtering of the image in spatial and velocity directions. Suitable descriptions of a spatiovelocity CSF model are known in the art; and application of such CSFs to video color distortion analysis is also known in the art. In some applications, local motion of the frame regions may be unknown, so a spatiotemporal CSF may also be used. One possible effect of this essentially low-pass filtering due to the SV-CSF, is that it would tend to reduce the signal amplitudes across L*, a*, and b* for certain regions, depending on their spatial frequency and velocity. It is typically harder to see distortions in higher spatial frequencies and higher velocities. The end effect of the filter is that it may allow larger pixel color distortions, yet still maintained below threshold visibility. This step may occur at the inverse filter stage, to be described later. In another embodiment, it may be desired that the SV-CSFs filters be different for the L*, a* and b* components and/or channels—e.g., with L* being the least aggressive filter, and b* being the most.

In one embodiment, processor 200 may CSF filter the entire image and then proceed on a per-pixel basis. For each pixel, it is possible to add a JND offset in both the positive and negative directions. The JND=1.0 may correspond to a threshold distortion (just noticeable difference). It is possible to process the L*, a* and b* channels as independent of each other in one embodiment as in blocks 208, 212, and 216 respectively. So these perturbations may be all non-detectable. It is possible to allow a scaling of the JND to account for applications where threshold performance may not be desired, but rather a visible distortion tolerance level.

For each of the three channels as shown in FIG. 2, it is possible to get two outputs—e.g., a '+' and a '−' output. This leaves a total of 8 combinations (2states^3-tuples=8). For each of the 8 combinations, it is possible we convert the filtered L*, a*, b* values to RGB values in block 220. Using luminous efficiencies of the display RGB primaries in block 218, it is possible to estimate the power consumed per pixel. Then for each of the 8 combinations of L*+/−, a*+/−, b*+/−, it is possible to find the lowest RGB power consumption. The combination that gives the lowest output may then be output in terms of its corresponding L*, a*, and b* values.

At blocks 222, 224 and 226 respectively, it is possible to apply the inverse CSF filters to return (possibly on a full-frame basis, as opposed to per pixel) the image frame back to its input state (e.g., unblurred). Then L*, a*, and b* values may be converted back to the RGB display driving values (or any other suitable driving values) at block 228. It should be appreciated that, in some cases, the algorithm may occur in the video pipeline where another format is needed (e.g., Y Cr Cb) at this stage. In addition, it should be appreciated that full-frame filtering may be done using usual local image convolution approaches, as well as FFT-based filtering.

Various Alternative Embodiments

As mentioned, the specific L*, a*, b* signals may not be required, and other simpler color formats can be used (e.g., YCrCb) or more advanced color appearance models can be used (e.g., CIECAM06), as well as future physiological models of these key properties of the visual system.

In addition, other, more accurate, estimates of the RGB power consumption may be possible, but it might be more complex. In this alternative, the inverse CSFs may be pulled into the power minimization selection procedure, where they may be applied prior to the conversion to RGB conversion. They may then be omitted after the power minimization step. This may be computational more expensive since 8 filtrations might be needed per frame.

It is also possible to combine more complex optimizations approaches with various components of embodiment given herein, for both still images and video applications. Such other example variations might include using just a spatial CSF, as opposed to the spatio-velocity CSF for cases where there is no motion (e.g., still images), or where system application issues require scaling down cost and complexity, size of filter kernels, or frame buffers as needed for any kind of spatiotemporal filtering.

A detailed description of one or more embodiments of the invention, read along with accompanying figures, that illustrate the principles of the invention has now been given. It is to be appreciated that the invention is described in connection with such embodiments, but the invention is not limited to any embodiment. The scope of the invention is limited only by the claims and the invention encompasses numerous alternatives, modifications and equivalents. Numerous specific details have been set forth in this description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The invention claimed is:

1. A method for image processing input image data and creating output image data, said output image data iso-perceptible to said input data and said output image data comprising a lower power requirement for rendering than said input image data, the steps of said method comprising:

color quantizing input image data;

creating a just-noticeable-difference (JND) set of image data, said JND set of image data being iso-perceptible to said input image data wherein the JND set of image data comprises a function of visibility thresholds for background luminance masking and texture masking, wherein creating a just-noticeable-difference (JND) set of image data further comprises:

computing:

$$C+=(Y+\mathrm{JND}_Y, Cb, Cr)$$

$$C-=(Y-\mathrm{JND}_Y, Cb, Cr),$$

wherein $\mathrm{JND}_Y$ comprises a spatial luminance just-noticeable-difference value; and computing:

$$\mathrm{JND}_Y(x,y)=T_l(x,y)+T_{t,Y}(x,y)-C_{l,t}\min\{T_l(x,y)+T_{t,Y}(x,y)\},$$

wherein $\mathrm{JND}_Y(x,y)$ comprises the spatial luminance JND value of pixel at location (x,y), $T_l(x,y)$ and $T_{t,Y}(x,y)$ comprise the visibility thresholds for the background luminance masking and texture masking, respectively, and $C_{l,t}$ comprises a weighting factor that controls the overlapping effect in masking; and selecting an output image data, said output image data chosen among said JND set of image data and said output image data comprising a lower power requirement for rendering than said input image data.

2. The method of claim 1 wherein said method further comprises the steps of:

creating an opponent color transformation of said color quantized input image data.

3. The method of claim 2 wherein said method further comprises the steps of:

filtering said opponent color transformed image data with a spatiovelocity CSF (SV-CSF) filter in spatial and velocity directions.

4. The method of claim 3 wherein said step of filtering further comprises the step of:

filtering the luminance and the opponent color components of said opponent color transformed image data image data with a spatiovelocity CSF (SV-CSF) filter in spatial and velocity directions.

* * * * *